US009334461B2

(12) United States Patent
Wirtensohn et al.

(10) Patent No.: US 9,334,461 B2
(45) Date of Patent: May 10, 2016

(54) HIGH TEMPERATURE GREASE

(75) Inventors: Gabriele Wirtensohn, Vaterstetten (DE); Martin Schweigkofler, Friedberg (DE); Martin Schmid-Amelunxen, Rohrmoos/Arzbach (DE)

(73) Assignee: Kluber Lubrication Munchen SE & Co. KG, Munich (DE)

( * ) Notice: Subject to any disclaimer, the term of this patent is extended or adjusted under 35 U.S.C. 154(b) by 0 days.

(21) Appl. No.: 14/343,921

(22) PCT Filed: Aug. 27, 2012

(86) PCT No.: PCT/EP2012/003600
§ 371 (c)(1), (2), (4) Date: Mar. 10, 2014

(87) PCT Pub. No.: WO2013/037456
PCT Pub. Date: Mar. 21, 2013

(65) Prior Publication Data

US 2014/0213492 A1 Jul. 31, 2014

(30) Foreign Application Priority Data

| | | |
|---|---|---|
| Sep. 15, 2011 | (DE) | 10 2011 113 499 |
| Apr. 16, 2012 | (DE) | 10 2012 007 673 |
| Jul. 31, 2012 | (DE) | 10 2012 015 648 |

(51) Int. Cl.

| | |
|---|---|
| ***C10M 111/04*** | (2006.01) |
| ***C10M 177/00*** | (2006.01) |
| ***C10M 105/40*** | (2006.01) |
| ***C10M 105/06*** | (2006.01) |
| ***C10M 169/00*** | (2006.01) |

(52) U.S. Cl.

CPC ..... *C10M 105/40* (2013.01); *C10M 105/06* (2013.01); *C10M 169/00* (2013.01); *C10M 2201/0616* (2013.01); *C10M 2201/1026* (2013.01); *C10M 2201/1036* (2013.01); *C10M 2201/1056* (2013.01); *C10M 2203/065* (2013.01); *C10M 2205/223* (2013.01); *C10M 2207/026* (2013.01); *C10M 2207/106* (2013.01); *C10M 2207/125* (2013.01); *C10M 2207/1256* (2013.01); *C10M 2207/1265* (2013.01); *C10M 2207/1285* (2013.01); *C10M 2207/282* (2013.01); *C10M 2207/288* (2013.01); *C10M 2207/2835* (2013.01); *C10M 2213/0606* (2013.01); *C10M 2213/0623* (2013.01); *C10M 2213/0626* (2013.01); *C10M 2215/06* (2013.01); *C10M 2215/064* (2013.01); *C10M 2215/065* (2013.01); *C10M 2215/10* (2013.01); *C10M 2215/1026* (2013.01); *C10M 2215/223* (2013.01); *C10M 2215/224* (2013.01); *C10M 2215/225* (2013.01); *C10M 2217/0213* (2013.01); *C10M 2217/044* (2013.01); *C10M 2217/0446* (2013.01); *C10M 2219/044* (2013.01); *C10M 2219/046* (2013.01); *C10M 2219/066* (2013.01); *C10M 2219/068* (2013.01); *C10M 2219/087* (2013.01); *C10M 2219/106* (2013.01); *C10M 2223/04* (2013.01); *C10M 2223/045* (2013.01); *C10M 2223/047* (2013.01); *C10M 2223/049* (2013.01); *C10N 2210/02* (2013.01); *C10N 2210/06* (2013.01); *C10N 2230/06* (2013.01); *C10N 2230/08* (2013.01); *C10N 2230/10* (2013.01); *C10N 2230/12* (2013.01); *C10N 2230/64* (2013.01); *C10N 2240/00* (2013.01); *C10N 2240/02* (2013.01); *C10N 2250/10* (2013.01)

(58) Field of Classification Search
None
See application file for complete search history.

(56) References Cited

U.S. PATENT DOCUMENTS

| | | | | |
|---|---|---|---|---|
| 4,298,481 | A | 11/1981 | Clarke | |
| 5,891,830 | A * | 4/1999 | Koltermann et al. | 508/136 |
| 6,331,509 | B1 * | 12/2001 | Heimann et al. | 508/136 |
| 2003/0176598 | A1 | 9/2003 | Takashima et al. | |
| 2004/0092408 | A1 | 5/2004 | Willey et al. | |
| 2010/0105586 | A1 * | 4/2010 | Bodesheim | C10M 133/40 508/244 |
| 2012/0098269 | A1 * | 4/2012 | Fujinami | 290/55 |

FOREIGN PATENT DOCUMENTS

| | | | |
|---|---|---|---|
| CN | 1718701 | A | 1/2006 |
| CN | 101880582 | A | 11/2010 |
| DE | 19653589 | A1 | 6/1997 |
| DE | 102004021812 | A1 | 12/2005 |
| EP | 1995300 | A1 | 11/2008 |
| WO | 2008154997 | A1 | 12/2008 |

* cited by examiner

*Primary Examiner* — Vishal Vasisth
(74) *Attorney, Agent, or Firm* — Maginot, Moore & Beck, LLP

(57) ABSTRACT

The invention relates to a high-temperature grease which is used inter alia in corrugated cardboard plants and comprises exclusively fluorine-free base oil.

15 Claims, No Drawings

HIGH TEMPERATURE GREASE

This application is a 371 of PCT/EP2012/003600, filed Aug. 27, 2012.

The invention relates to a fluorine-free high-temperature grease which is used in corrugated cardboard plants among other installations.

In the production of corrugated cardboard in corrugated cardboard plants, the corrugation web paper is brought into the desired shape by corrugating rollers, under pressure and with hot steam. The corrugating rollers are therefore exposed to high temperatures, and hence the lubricating greases used are required to satisfy exacting requirements.

In the journal Machinery Lubrication (September 2001), the author John Graham describes perfluoropolyether greases as being the only sensible products that can be used for high-temperature applications, of the kind required in corrugated cardboard plants.

As already observed above, in the corrugated cardboard plants, the corrugating roller is the critical lubrication point, since it is here that high temperatures must be applied in order to bond the paper webs under high pressure and at high temperatures. The corrugating roller is a steam-heated roller, for which the typical roller operating temperatures are situated in the range from 150 to 180° C.

In order to ensure that the corrugating rollers in the corrugated cardboard plants operate continuously, oil lubrication is carried out via circulating lubrication. This is a complicated method, involving a lot of oil being consumed. As an alternative it is also possible to use mineral oil greases; here again, the consumption of grease is very high as a result of the continuous relubrication.

The high pressure and temperature requirements in corrugating rollers have been met in the past only by greases based on perfluoropolyether oils (PFPE), which comprise polytetrafluoroethylene or soaps as thickeners. An alternative is to use lubricating greases which include an at least increased fraction of PFPE (known as hybrid greases). Even when used with PFPE greases, relubrication is necessary every three weeks.

Since a high level of grease consumption is recorded as a result of the continual relubrication, and since PFPE greases are very expensive, there is a great demand for inexpensive greases that may be used, for example, in corrugating rollers in corrugated cardboard plants. The requirements imposed on these greases are very exacting, since there should be no wear at high temperatures and since the greases must not harden up; moreover, they are to be resistant to corrosion and oxidation.

It is therefore an object of the present invention to provide greases which are free from fluorinated base oils, more particularly free from PFPE-containing base oils. These greases ought to be inexpensively producible and ought to minimize the environmental burden, since it is possible to do without the use of fluorinated base oils. There should also be no shortening in the relubrication intervals.

This object is achieved, surprisingly, through the provision of a high-temperature grease for which the base oil used is an alkylated naphthalene or a dipentaerythritol ester, and also mixtures thereof, and for which fluorinated base oils are not used.

The high-temperature grease of the invention comprises:

(A) 20 to 88 weight % of fluorine-free base oil, (B) 45 to 10 weight % of thickener(s), (C) 15 to 2 weight % of additives, and (D) 20 to 0 weight % of a further fluorine-free oil component.

A particularly preferred high-temperature grease comprises:

(A) 60 weight % of fluorine-free base oil, (B) 31 weight % of thickener(s), (C) 9 weight % of additives, and The component (A) used as base oil is selected from the group consisting of alkylated naphthalene, dipentaerythritol esters, or mixtures thereof. For the production of a corrugator it is advantageous to use alkylated naphthalene as component (A). If a high-temperature grease is produced for hoop segment sliders, it is advisable to use dipentaerythritol esters as components (A).

Used as component (B) are PTFE, metal soaps, such as lithium complex soaps, aluminum complex soaps, sodium complex soaps, boron nitride, Aerosil, silicates, such as bentonite, organic high-temperature polymers, such as polyimides and polyamidimides, individually or in combination.

Used as component (C) are additives to counter wear oxidation, corrosion, and also additives to reduce the friction or improve the high-pressure properties.

Antioxidants used are, in particular, antioxidants which may comprise sulfur and/or nitrogen and/or phosphorus in the molecule. They are selected from the group consisting of aromatic aminic antioxidants, such as alkylated phenyl-alpha-naphthylamine, dialkyldiphenylamine, aralkylated diphenylamine, sterically hindered phenols, such as butylated hydroxytoluene (BHT), phenolic antioxidants having thioether groups, Zn or Mo or W dialkyldithiophosphates, and phosphites, which are used individually or in combination.

The wear inhibitor is selected from the group consisting of antiwear additives based on diphenyl cresyl phosphate, amine neutralized phosphates, alkylated and nonalkylated triaryl phosphates, alkylated and nonalkylated triaryl thiophosphates, zinc or Mo or W dialkyldithiophosphates, carbamates, thiocarbamates, zinc or Mo or W dithiocarbamates, dimercaptothiadiazole, calcium sulfonates, and benzotrizole derivatives, which are used individually or in combination.

The corrosion inhibitor is selected from the group consisting of additives based on overbased Ca sulfonates having a TBN of 100 to 300 mg KOH/g, amine-neutralized phosphates, alkylated Ca naphthalene-sulfonates, oxazoline derivatives, imidazole derivatives, succinic monoesters, N-alkylated benzotriazoles, which are used individually or in combination.

As further oil component (D) there are compounds selected from the group consisting of esters, synthetic hydrocarbons, natural oils, group III oils, which are used individually or in combination. Group III oils are mineral oils that have undergone specific processing. Mineral oils used may be polyglycols, silicone oils, or alkylated benzenes.

The high-temperature grease of the invention can be used not only for lubricating corrugating rollers in corrugated cardboard plants, but also for high-temperature applications in roller bearings and sliding points for long-term lubrication, for which the temperatures attain not more than 200° C. Furthermore, the high-temperature grease of the invention may be used in hoop segment sliders.

The above-described requirements that the greases of the invention are intended to meet are modeled by FE 8 tests in tapered roller bearings at 150° C. and spherical roller bearings at 180° C. (DIN 51819 FAG); the results are shown in tables 1 and 2.

In these investigations it emerged, surprisingly, that greases without PFPE have outstanding properties.

The high-temperature grease of the invention is characterized in more detail by the examples which follow.

In all cases the lubricating greases have a shear viscosity of between about 5000 and 10 000 mPas, measured at a shear rate of 300 l/s in cone/plate geometry. Recruited as PFPE reference specimens were examples 5 and 6, of which example 6 is frequently used for lubricating corrugating rollers in corrugated cardboard machines. In order to be able to compare the base oils of the example greases in relation to lubricating film thicknesses, the dynamic viscosities at 40° C. between 160 mPas and 550 mPas were selected.

Unless otherwise indicated, the percentages in the examples relate to weight %.

EXAMPLES

Example 1

| | |
|---|---|
| 31% | PTFE |
| 60% | alkylated naphthalene |
| 4% | aminic antioxidant |
| 5% | metal soap as corrosion inhibitor. |

The alkylated naphthalene is heated in a vessel to about 100° C. Thereafter the antioxidant is added and the mixture is stirred until a clear solution is obtained. The contents of the vessel are cooled and then the metal soap and the PTFE are incorporated homogeneously with stirring. Finally, the grease is homogenized on a triple-roll mill.

Example 2

| | |
|---|---|
| 34% | PTFE |
| 28.5% | ester |
| 28.5% | alkylated naphthalene |
| 4% | aminic antioxidant |
| 5% | metal soap as corrosion inhibitor. |

The alkylated naphthalene and the ester are heated in a vessel to about 100° C. Thereafter the antioxidant is added and the mixture is stirred until a clear solution is obtained. The contents of the vessel are cooled and then the metal soap and the PTFE are incorporated homogeneously with stirring. Finally, the grease is homogenized on a triple-roll mill.

Example 3

| | |
|---|---|
| 33% | PTFE |
| 59% | ester |
| 4% | aminic antioxidant |
| 4% | metal soap as corrosion inhibitor. |

The ester is heated in a vessel to about 100° C. Thereafter the antioxidant is added and the mixture is stirred until a clear solution is obtained. The contents of the vessel are cooled and then the metal soap and the PTFE are incorporated homogeneously with stirring. Finally, the grease is homogenized on a triple-roll mill.

Example 4

| | |
|---|---|
| 31% | boron nitride |
| 60% | alkylated naphthalene |
| 4% | aminic antioxidant |
| 5% | metal soap as corrosion inhibitor. |

The alkylated naphthalene is heated in a vessel to about 100° C. Thereafter the antioxidant is added and the mixture is stirred until a clear solution is obtained. The contents of the vessel are cooled and then the metal soap and the boron nitride are incorporated homogeneously with stirring. Finally, the grease is homogenized on a triple-roll mill.

Comparative Example 1

| | |
|---|---|
| 21% | PTFE |
| 77% | PFPE |
| 2% | metal soap as corrosion inhibitor |

PFPE, PTFE, and metal soap are stirred homogeneously and the resulting grease is homogenized on a triple-roll mill.

Comparative Example 2

| | |
|---|---|
| 18% | metal soap |
| 82% | PFPE |

The metal soap is incorporated into the PFPE by stirring, and the resulting grease is homogenized on a triple-roll mill.

Comparative Example 3

| | |
|---|---|
| 64% | dipentaerythritol ester-based urea grease, additized with antioxidant, corrosion inhibitor, and wear inhibitor |
| 5% | PTFE |
| 31% | PFPE |

The urea grease is stirred homogeneously with PTFE and PFPE, and the resulting grease is homogenized on a triple-roll mill.

TABLE 1

| | Ex. 1 | Ex. 2 | Ex. 3 | Ex. 4 |
|---|---|---|---|---|
| Kin. base-oil viscosity (40° C.) | 180 cst | 290 cst | 400 cst | 180 cst |
| Dyn. base-oil viscosity (40° C.) | 160 mPas | 260 mPas | 380 mPas | 160 mPas |
| Shear viscosity (300 1/s, cone/plate) | 6100 mPas | 5400 mPas | 8200 mPas | 9700 mPas |
| Evaporation loss (7 days at 180° C.) | 8.2% | 6.4% | 3.7% | 10.2% |
| Shear viscosity (300 1/s, cone/plate after 7 days at 180° C.) | 10 200 mPas | 17 500 mPas | 12 400 mPas | 23 600 mPas |
| Oil deposition (30 h at 180° C.) | 3.3% | 1.6% | 3.4% | 5.9% |
| FE8 test with spherical roller bearings (180° C.) | Friction low 500 h run time passed | | Friction moderate 500 h run time passed | |
| FE8 test with tapered roller bearings (150° C.) | Friction low rolling body wear: 4.5 mg very low | | | |

TABLE 2

| | Compar. ex. 1 | Compar. ex. 2 | Compar. ex. 3 |
|---|---|---|---|
| Kin. base-oil viscosity (40° C.) | 100 cst | 240 cst | 420 cst |
| Dyn. base-oil viscosity (40° C.) | 190 mPas | 450 mPas | 550 mPas |
| Shear viscosity (300 1/s, cone/plate) | 4900 mPas | 10 000 mPas | 7200 mPas |
| Evaporation loss (7 days at 180° C.) | 16.8% | 2.2% | 23.8% |
| Shear viscosity (300 1/s, cone/plate after 7 days at 180° C.) | 7400 mPas | 14 200 mPas | |
| Oil deposition (30 h at 180° C.) | 11.5% | 15.1% | 3.2% |
| FE8 test with spherical roller bearings (180° C.) | Friction moderate, 500 h run time passed | Friction very low, 500 h run time passed | Friction low, 500 h run time passed |
| FE8 test with tapered roller bearings (150° C.) | | Friction low rolling body wear: 21.5 mg low | Friction low rolling body wear: 56.5 mg moderate |

Surprisingly it was found that the high-temperature greases of the invention from examples 1 to 3, even after in-bearing use at 180° C., were just as lubricious after 7 days as the PFPE grease from comparative example 2. In the stated cases the shear viscosity was less than 20 000 mPas. Example grease 4 as well was still lubricious, at 23 600 mPas.

Under the stated experimental conditions, the evaporation losses of the greases from examples 1 to 4 were not higher than 10.2%, and accordingly lie within the range of the comparative PFPE greases 1 and 2, and are significantly better than the proportionally PFPE-containing comparative example 3.

The oil deposition values of example greases 1 to 4, determined after 30 hours at 180° C., were significantly lower in all cases than the oil deposition values of the PFPE greases of comparative examples 1 and 2, or equivalent to the oil deposition of comparative example 3. Low oil deposition values result in lower oil leakage at the bearing, and are advantageous for long-term lubrication.

In order to reproduce the collective loading in corrugating rollers of corrugated cardboard plants, FE8 tests with spherical roller bearings at 180° C. were conducted on example greases 1 and 3 and also on comparative examples 1, 2, and 3. All five greases attained the target bearing run time of 500 hours. Example grease 1, in particular, came very close to the excellent friction conditions of certain PFPE-containing greases, such as comparative example 2 or 3, or was indeed superior to comparative example 1.

In FE8 tests with tapered roller bearings at 150° C., on example grease 1 and on comparative examples 2 and 3, the equivalent frictional behavior was confirmed. In these tests it was possible at the same time to show that the outstanding wear behavior, established in practice on corrugating rollers, of PFPE-containing greases (comparative examples 2 and 3) was in fact even exceeded by example grease 1.

The invention claimed is:

1. A high-temperature grease consisting essentially of:

(A) 20 to 88 weight % of fluorine-free base oil, consisting essentially of either alkylated naphthalene, dipentaerythritol esters, or mixtures thereof, (B) 45 to 10 weight % of thickener(s), consisting essentially of PTFE, (C) 15 to 2 weight % of additives, and (D) 20 to 0 weight % of a further fluorine-free oil component selected from the group of compounds consisting of esters, synthetic hydrocarbons, natural oils, group III oils which are used individual or in combination.

2. The high-temperature grease as claimed in claim 1, for which, as component (C), additives to counter wear, oxidation, corrosion and also additives to reduce the friction or improve the high-pressure properties are used.

3. The high-temperature grease as claimed in claim 2, for which, as additives, antioxidants are used which comprise at least one of sulfur, nitrogen and phosphorus in the molecule, which are used individually or in combination and are aromatic aminic antioxidants, which are used individually or in combination.

4. The high-temperature grease as claimed in claim 2, for which, as additives, wear inhibitors are used which are selected from the group consisting of antiwear additives based on diphenyl cresyl phosphate, amine neutralized phosphates, alkylated and nonalkylatedtriaryl phosphates, alkylated and nonalkylatedtriaryl thiophosphates, zinc or Mo or W dialkyldithiophosphates, carbamates, thio-carbamates, zinc or Mo or W dithiocarbamates, dimercaptothiadiazole, calcium sulfonates, and benzotrizole derivatives, which are used individually or in combination.

5. The high-temperature grease as claimed in claim 2, for which, as additives, corrosion inhibitors are used which are selected from the group consisting of additives based on overbased Ca sulfonates having a TBN of 100 to 300 mg KOH/g, amine-neutralized phosphates, alkylated Ca naphthalene-sulfonates, oxazoline derivatives, imidazole derivatives, succinic monoesters, N-alkylated benzotriazoles, which are used individually or in combination.

6. The high-temperature grease as claimed in claim 1, which is used in rolling bearings or sliding points for long-term lubrication, for which the temperatures attain not more than 200° C.

7. The high-temperature grease as claimed in claim 1, for which the kinematic viscosity of component (A), measured at 40° C., is at least 100 $mm^2$/sec.

8. The high-temperature grease as claimed in claim 1, which is used in rolling bearings or sliding points for long-term lubrication, for which the temperatures attain not more than 200° C.

9. The high-temperature grease as claimed in claim 1, for which the kinematic viscosity of component (A), measured at 40° C., is at least 100 $mm^2$/sec.

10. The high-temperature grease as claimed in claim 3, which is used in rolling bearings or sliding points for long-term lubrication, for which the temperatures attain not more than 200° C.

11. The high-temperature grease as claimed in claim 3, which is used in corrugating rollers of corrugated cardboard plants.

12. The high-temperature grease as claimed in claim 3, which is used in hoop segment sliders.

13. The high-temperature grease as claimed in claim 3, for which the kinematic viscosity of component (A), measured at 40° C., is at least 100 $mm^2$/sec.

14. The high-temperature grease as claimed in claim 3, wherein the aromatic aminic antioxidants are selected from a group consisting of alkylated phenyl-alpha-naphthylamine, dialkyldiphenylamine, aralkylateddiphenylamines, sterically hindered phenols.

15. The high-temperature grease as claimed in claim 14, wherein the aromatic aminic antioxidants are selected from a group consisting of butylated hydroxytoluene (BHT), phenolic antioxidants having thioether groups, Zn or Mo or W dialkyl-dithiophosphates, and phosphites.

* * * * *